US009200844B2

(12) United States Patent
Katakura et al.

(10) Patent No.: US 9,200,844 B2
(45) Date of Patent: Dec. 1, 2015

(54) ROTARY AGITATION TYPE HEAT TREATMENT APPARATUS

(75) Inventors: Masayuki Katakura, Kanagawa (JP); Hiromitsu Suzuki, Ibaraki (JP); Takahiro Goto, Hokkaido (JP)

(73) Assignee: NISSHIN ENGINEERING INC., Tokyo (JP)

( * ) Notice: Subject to any disclaimer, the term of this patent is extended or adjusted under 35 U.S.C. 154(b) by 660 days.

(21) Appl. No.: 13/491,064

(22) Filed: Jun. 7, 2012

(65) Prior Publication Data

US 2013/0329515 A1 Dec. 12, 2013

(51) Int. Cl.
*F27B 7/14* (2006.01)

(52) U.S. Cl.
CPC ..... *F27B 7/14* (2013.01)

(58) Field of Classification Search
CPC ..... F27B 7/14; F27B 7/18
USPC ..... 34/135, 137; 366/221
See application file for complete search history.

(56) References Cited

U.S. PATENT DOCUMENTS 3,142,546 A * 7/1964 Coats ..... 34/137
3,298,679 A * 1/1967 Krautheim et al. ..... 366/221

FOREIGN PATENT DOCUMENTS

EP 1 785 684 A1 5/2007
JP H 10-148471 A 6/1998
JP 11-281257 10/1999
JP 2000-42437 2/2000
JP 2001-012858 A 1/2001
JP 2001-349675 A 12/2001
JP 2002-081866 A 3/2002
JP 2004-239557 8/2004
JP 2005-270955 A 10/2005
JP 2005-351495 A 12/2005
JP 2006-138535 A 6/2006
JP 2008-045863 A 2/2008
JP 2009-000633 1/2009
JP 2009-222309 A 10/2009
JP 2010-214314 9/2010
JP 2011-038653 2/2011

OTHER PUBLICATIONS

Japanese Office Action for Japanese Application No. 2009-269714 dated Dec. 3, 2013 with English translation (9 pages).

* cited by examiner

*Primary Examiner* — David Sorkin
(74) *Attorney, Agent, or Firm* — Muncy, Geissler, Olds & Lowe, P.C.

(57) ABSTRACT

A rotary agitation type heat treatment apparatus includes: a cylindrical member for performing heat treatment on a material to be treated supplied inside the cylindrical member from one end thereof; a rotating unit for rotating the cylindrical member; a heating unit for heating the material supplied inside the cylindrical member; and agitation members arranged in the cylindrical member. Each agitation member has a shaft structure and two or more blades provided on the shaft structure. The cylindrical member and the agitation members are constituted of a ceramic material. The material inside the cylindrical member is heated and the cylindrical member is rotated, so that the material is heat treated while agitated by the agitation members in the cylindrical member, and discharged out from the other end thereof.

11 Claims, 8 Drawing Sheets

ROTARY AGITATION TYPE HEAT TREATMENT APPARATUS

BACKGROUND OF THE INVENTION

The present invention relates to a rotary agitation type heat treatment apparatus (rotary kiln) that performs agitating and heating treatment, as it rotates, on a material to be treated (which may be referred to as subject material below) and in particular to a rotary agitation type heat treatment apparatus wherein a rotary cylindrical member through which the subject material passes and agitation members disposed in the rotary cylindrical member to agitate the subject material are made of ceramic materials.

There is known in the art a rotary agitation type heat treatment apparatus having a metallic agitation member (blade member having radially extending blades, which may be hereinafter referred to as blade member) disposed inside a metallic rotary cylindrical member for agitation of a subject material or other purposes (see, for example, JP 2000-42437 A).

JP 2000-42437 A describes a crushing/pulverizing/sizing apparatus comprising inside a rotatable cylindrical member a metallic beater member having a plurality of radially extending blades, normally three blades (corresponding to a metallic agitation member) and a rolling shaft extending in the longitudinal direction (the direction of the axis of rotation) of the rotary cylindrical member.

The crushing/pulverizing/sizing apparatus described in JP 2000-42437 A causes a subject material in solid, fluid, or other states to undergo crushing, distributing, pulverizing, sizing or other processing by allowing the metallic beater member (metallic agitation member) to rotate in accordance with the rotation of the rotary cylindrical member and the rolling shaft to move inside the rotary cylindrical member.

JP 2009-00633 A describes an apparatus for performing crushing, distributing, sizing, and other processing on a subject material in solid, fluid, or other states by allowing beads instead of the rolling shaft to move inside a rotary cylindrical member.

A metallic beater member such as one as described in JP 2000-42437 A (metallic agitation member) is provided as a separate member from the rotary cylindrical member in the rotary cylindrical member so that as the rotary cylindrical member rotates, the edge portions of the blades of the metallic beater member (metallic agitation member) hit the inner wall of the rotary cylindrical member. Thus, the agitation member is caused to roll and turn inside the rotary cylindrical member. The impact generated as the edge portions of the blades hit the inner wall of the rotary cylindrical member vibrates the inner wall of the rotary cylindrical member and the agitation member and thereby prevents the subject material from adhering to and seizing to the inner wall of the rotary cylindrical member and the surface of the agitation member, as the subject material is agitated and distributed.

Further, the rolling of the rolling shaft disposed between two blades of the agitation member accompanying the rotation of the rotary cylindrical member prevents the subject material from adhesion and deposition and causes the subject material to crush and distribute.

JP 2009-00633 A further describes efficient pulverization, crushing, sizing, distribution, among others, of the subject material achieved by disposing dispersing media such as beads, balls, and polygons between blades.

SUMMARY OF THE INVENTION

At present, agitation members are made of metals. In recent years, there is an increasing demand for production facilities using, for example, ceramic materials, which prevent contamination caused by, for example, a foreign metal occurring during manufacture of battery materials such as positive electrode materials of secondary lithium-ion batteries and have resistance to alkali corrosion. Therefore, development of a rotary agitation type heat treatment apparatus using a nonmetal material resistant to alkali corrosion is strongly desired, with also the agitation member made of a ceramic material.

When a battery material of, for example, a positive electrode material of a secondary lithium-ion battery is heat-treated, it is of great concern to prevent contamination caused by entry of a foreign metal in baking process, as exemplified by contamination by liquidation of metallic ions from the components of a baking apparatus occurring during high-temperature heat treatment and occurrence of metal powder resulting from abrasion caused by mechanical contact.

Solving these problems related to metal contamination requires the rotary cylindrical member and the agitation member, among other components, to be made of ceramic materials such as, for example, silicon carbide, alumina, mullite, and zirconia, i.e., materials other than metal materials. However, ceramic materials have a drawback of having a lower mechanical impact strength and a lower thermal shock strength than metal materials. More specifically, where an agitation member having two or more blades is made of a ceramic material, the shaft structure or the edge portions of the blades are liable to suffer damage from the impact with which the edge portions of the blades of the ceramic agitation member hit the inner wall of the ceramic rotary cylindrical member. In this case, the ceramic rotary cylindrical member also has an increased chance of being damaged.

When the thickness of the shaft structure of a ceramic agitation member is increased in order to increase the mechanical strength of the shaft structure of the ceramic agitation member, the weight of the agitation member in turn increases, and so does the weight load onto the rotary cylindrical member accordingly, increasing the impulsive force and thereby increasing the risk of the ceramic rotary cylindrical member being damaged.

Further, where the thicknesses of the ceramic rotary cylindrical member and the shaft structure of the ceramic agitation member are increased in order to increase their mechanical strengths, when both the rotary cylindrical member and the ceramic agitation member are cooled together after a series of heat treatment of the subject material is completed, the ceramic agitation member, in particular, is liable to be cooled inconsistently such that cooling takes place increasingly later with the increasing depth toward the center, thereby increasing the chance of occurrence of damage attributable to thereby caused thermal contraction.

Thus, using the rotary cylindrical member and the agitation member both made of ceramic materials is at present difficult.

An object of the present invention is to overcome the problems associated with the prior art described above and provide a rotary agitation type heat treatment apparatus using a rotary cylindrical member and an agitation member both made of ceramic materials.

In order to achieve the above object, the present invention provides a rotary agitation type heat treatment apparatus comprising: a cylindrical member for performing heat treatment on a material to be treated which is supplied inside the cylindrical member; a rotating unit for rotating the cylindrical member; a heating unit for heating the material to be treated which is supplied inside the cylindrical member; and agitation members arranged in the cylindrical member along a longitudinal direction, wherein: the agitation members each have a shaft structure and two or more blades provided on the shaft structure; the cylindrical member and the agitation members are constituted of a ceramic material; and the material to be treated which is supplied inside the cylindrical member from one end thereof is heated by the heating unit and the cylindrical member is rotated by the rotating unit, so that the material to be treated is heat treated while agitated by the agitation members in the cylindrical member, and discharged out from another end of the cylindrical member.

In the present invention, it is preferable that the shaft structure of each of the agitation members is arranged in substantially parallel to a rotation axis of the cylindrical member, the two or more blades of each of the agitation members are plate-shaped and radially provided on the shaft structure in an evenly spaced manner, one or two blades of the two or more blades of each of the agitation members are in contact with an inner wall surface of the cylindrical member so that the agitation members are supported by the cylindrical member as the cylindrical member rotates, in each of the agitation members, one blade of the two or more blades in contact with the inner wall surface of the cylindrical member become out of contact with the inner wall surface of the cylindrical member, and another blade of the two or more blades out of contact with the inner wall surface of the cylindrical member become in contact with the inner wall surface of the cylindrical member so that the two or more blades of each of the agitation members roll and turn in the cylindrical member, and the material to be treated being supplied in the cylindrical member is agitated by the agitation members.

It is also preferable in the present invention that the two or more blades of each of the agitation members are plate-shaped and radially provided on the shaft structure in an evenly spaced manner, the shaft structure of each of the agitation members is a central coupling portion to which the two or more blades are coupled the agitation members are arranged in the cylindrical member such that a virtual center line of the central coupling portion may be substantially parallel to a rotation axis of the cylindrical member.

In the present invention, it is preferable that the agitation members each have three blades provided on a periphery of the shaft structure in an evenly spaced manner.

It is also preferable in the present invention that the agitation members each have two blades provided on a periphery of the shaft structure in an evenly spaced manner.

In the present invention, it is preferable that the shaft structure of each of the agitation members is in a form of a quadrangular prism which is hollow and has quadrangular holes formed in its both bases, and the blades are radially provided on a pair of opposite edges of the quadrangular prism; and that each agitation member is positioned in the cylindrical member so that a virtual center line of the quadrangular prism may be substantially parallel to a rotation axis of the cylindrical member.

It is also preferable in the present invention that the shaft structure is in a form of a cylinder which is hollow and has circular holes formed in its both bases, and the blades are radially provided on generatrices of the cylinder; and that each of the agitation members is positioned in the cylindrical member so that a virtual center line of the cylinder may be substantially parallel to a rotation axis of the cylindrical member.

It is also preferable in the present invention that the shaft structure is in a form of a polyangular prism which is hollow and has polygonal holes formed in its both bases, and the blades are radially provided on edges of the polyangular prism; and that each of the agitation members is positioned in the cylindrical member so that a virtual center line of the polyangular prism may be substantially parallel to a rotation axis of the cylindrical member.

In the present invention, it is preferable that the blades of the agitation members have edge portions of a semicircular shape.

In the present invention, it is preferable that the agitation members each have an end face brought into contact with an adjacent agitation member, and the end face is convex in shape.

In the present invention, it is preferable that the ceramic material of which the cylindrical member and the agitation members are constituted is one selected from among silicon carbide, alumina, mullite, and zirconia.

According to the present invention, a desired heat treatment can be carried out with no contamination of the subject material with metallic foreign matter by making both the cylindrical member and the agitation members constituted of a ceramic material. If granulated powder prepared from a powdery lithium compound and a powdery metal compound is to be used as the subject material in order to obtain a positive electrode material for secondary lithium-ion batteries, for instance, it is possible to prevent the seizing of the subject material to the inner wall of the cylindrical member due to the melting of lithium during heat treatment, and continuously bake the subject material for a short time so as to obtain a high-quality positive electrode material for secondary lithium-ion batteries.

Currently, baking using a roller hearth kiln is a mainstream method of baking a positive electrode material for secondary lithium-ion batteries. The method requires about 20 hours for heating and temperature maintenance, with the time to be taken for the whole production including a cooling process being 30 hours or more.

On the other hand, according to the present invention, the heat treatment time can be reduced to an extent of only 30 minutes in the production of a positive electrode material for secondary lithium-ion batteries, which allows the production including a cooling process to be carried out within one hour. In consequence, production costs of a positive electrode material for secondary lithium-ion batteries can be reduced and, in addition, $CO_2$ emissions can significantly be suppressed during the production. Moreover, even a considerable contribution can be made to global environmental conservation with the present invention because a secondary lithium-ion battery using the positive electrode material for secondary lithium-ion batteries as produced according to the present invention is usable for electric vehicles, hybrid vehicles, and the like.

DETAILED DESCRIPTION OF THE INVENTION

Figure 1:
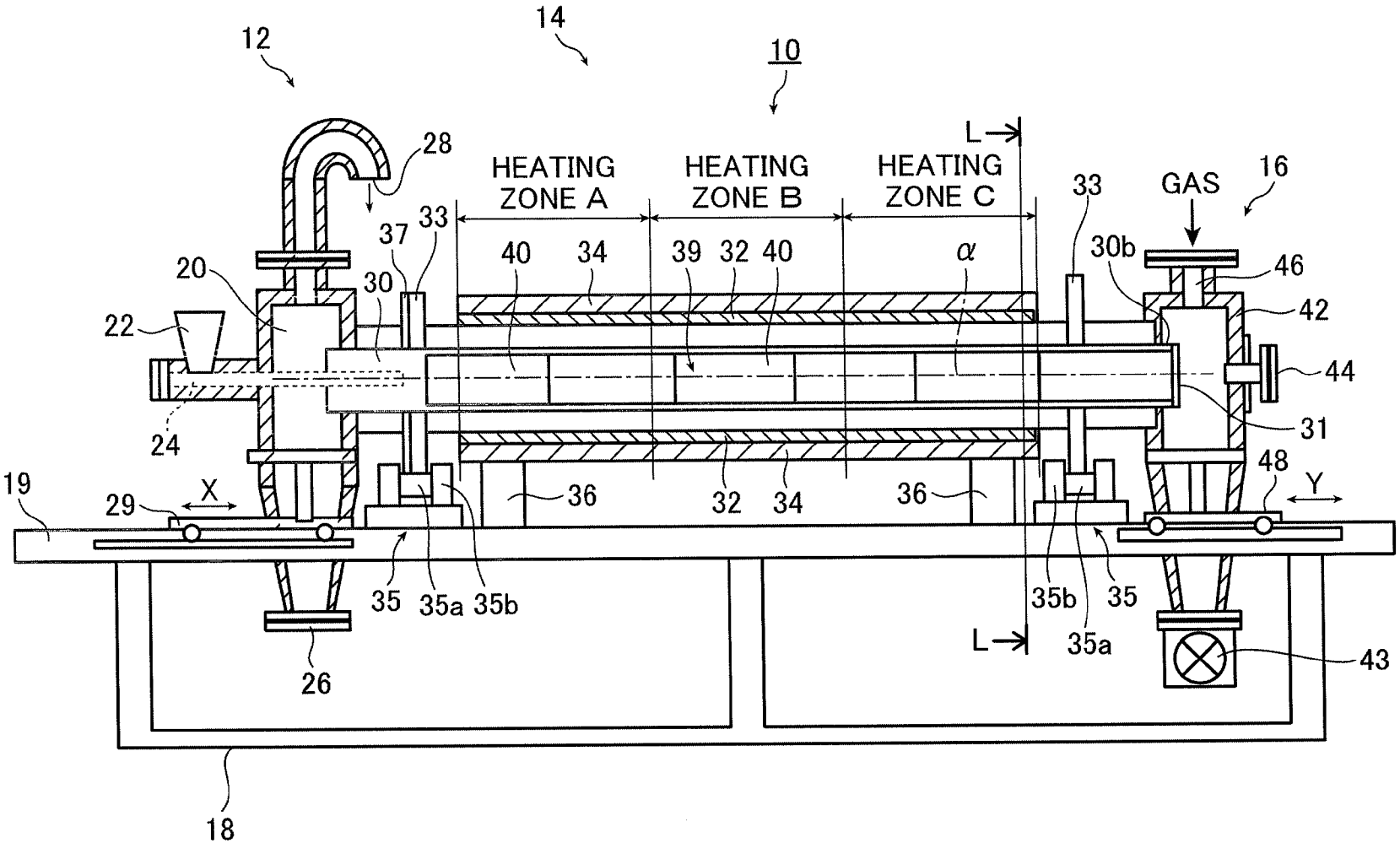
FIG. 1 is a schematic cross section illustrating a rotary agitation type heat treatment apparatus according to a first embodiment of the invention.

The rotary agitation type heat treatment apparatus of the invention will be now described in detail based on preferred embodiments illustrated in the attached drawings.

A rotary agitation type heat treatment apparatus 10 comprises a supply unit 12, a treatment unit 14, and a discharge unit 16. The supply unit 12, the treatment unit 14, and the discharge unit 16 are provided on a mount 19 of a support base 18.

The supply unit 12 is provided on one end of the treatment unit 14; the discharge unit is provided on the other end.

In the supply unit 12, a supply casing body 20 comprises a hopper 22 for supplying a subject material (e.g., raw material for producing the positive electrode material of a secondary lithium-ion battery) into the treatment unit 14. The hopper 22 is provided with a supply duct 24 extending into the treatment unit 14 through the supply casing body 20. The supply duct 24 includes a screw type feeder (not shown) therein.

At the bottom portion of the supply casing body 20, a lid unit 26 is provided. A subject material, for example, mixed into the supply casing body 20 can be recovered from the supply casing body 20 by opening the lid unit 26.

There is provided at the top portion of the supply casing body 20 a gas discharge outlet 28 for discharging, for example, inactive gas and a gas component generated by baking reaction, supplied into the treatment unit 14 through the other end of the treatment unit 14 (the side closer to the discharge unit 16 described later) to the outside of the rotary agitation type heat treatment apparatus 10 as will be described later. The above gases can be efficiently discharged by connecting a suction mechanism for sucking gas (not shown) to the gas discharge outlet 28.

The supply unit 12 is supported by the support base 18 through a moving unit 29. When the moving unit 29 is moved in a direction X shown by an arrow in FIG. 1, the supply unit 12 can be moved with respect to one end of the treatment unit 14 (the end located on the side where the subject material is supplied). This facilitates inspection of the inside of the treatment unit 14.

In the discharge unit 16, the subject material having undergone heat treatment through the treatment unit 14 is discharged into the discharge side casing body 42 as will be described. The bottom portion of the discharge side casing body 42 is connected with a rotary valve 43, and the rotation of the rotary valve 43 causes the subject material located inside the discharge side casing body 42 to be continuously discharged to the outside of the discharge side casing body 42. The rotary valve 43 need not necessarily be provided.

The discharge side casing body 42 is provided with a sight hole 44 for observing the state of the discharge of the subject material from the treatment unit 14 and the state inside the discharge side casing body 42.

The discharge side casing body 42 is connected with a gas supply device (not shown) for supplying, for example, active gas, inactive gas, and vapor. Active gas, inactive gas, and vapor, for example, supplied from the gas supply device are supplied into the discharge side casing body 42 through a gas supply duct 46 of the discharge side casing body 42.

The active gas, inactive gas, and vapor, for example, introduced into the discharge side casing body 42 pass through the treatment unit 14 toward the supply unit 12. Thus, in the rotary agitation type heat treatment apparatus 10, the subject material is supplied from one end of the treatment unit 14 while active gas, inactive gas, and vapor, for example, are supplied from the other end of the treatment unit 14.

The discharge unit 16 is supported by the support base 18 through a moving unit 48 that is movable in a direction Y shown by an arrow in FIG. 1. Moving the moving unit 48 in the direction Y facilitates inspection of the inside of the treatment unit 14.

The moving unit 48 of the discharge unit 16 has the same structure as the moving unit 29 of the supply unit 12.

Next, the treatment unit 14 will be described. The treatment unit 14 in this embodiment applies heat treatment to the subject material supplied from the hopper 22 while also performing such processes as, for example, distribution, sizing, and crushing.

The treatment unit 14 in this embodiment includes a cylindrical member 30. The cylindrical member 30 is inclined with respect to the mount 19 so that one side thereof (on the side from which the subject material is supplied) is higher than the other side (discharge side). Thus, the side of the cylindrical member 30 is so inclined that the side thereof closer to the discharge unit 16 is lower than the side closer to the supply unit 12.

Therefore, the subject material supplied from the hopper 22 of the supply unit 12 to an opening 30*a* located on the one end of the cylindrical member 30 of the treatment unit 14 moves toward the other end, the discharge unit 16 as the subject material undergoes heat treatment in accordance with the rotation of the cylindrical member 30. Upon reaching the other end of the cylindrical member 30, the subject material falls from an opening 30*b* formed at the other end of the cylindrical member 30 into the discharge side casing body 42.

The treatment unit 14 comprises the cylindrical member 30, a heater member 32 provided so as to surround the periphery of the cylindrical member 30 with a gap from the cylindrical body 30, and a thermal insulation member 34 provided so as to cover the heater member 32. The treatment unit 14 is disposed on the mount 19 of the support base 18 through support members 36.

As described later, the cylindrical member 30 is rotatable and contains in an inner space 30*c* a plurality of ruddy blade members (agitation members) 40 disposed independently of each other so that heat treatment is performed in the inner space 30*c*.

The cylindrical member 30 is made of a ceramic material. Ceramic materials that may be used herein include, for example, silicon carbide, alumina, mullite, and zirconia; alumina having a purity of 99.6% or more is particularly preferable.

The heater member 32 is made of, for example, a resistance heater. The resistance heater is connected with an alternating or a direct current power source (not shown). The resistance heater is supplied with electric current to heat the cylindrical member 30. There is provided a gap between the peripheral surface of the cylindrical member 30 and the inner surface of the heater member 32 to allow the cylindrical member 30 to rotate with respect to the fixedly provided heater member 32.

The treatment unit 14 has three heating zones, a heating zone A, a heating zone B, and a heating zone C. The heating zone A, the heating zone B, and the heating zone C are each provided with a resistance heater as the heater member 32, and each resistance heater is so provided that each resistance heater can be applied with a voltage. Thus, the heating temperatures in the heating zone A, the heating zone B, and the heating zone C can be so set as to be different from each other.

The cylindrical member 30 may be heated at the same temperature throughout its length, or some region or regions may be left unheated. The number of heating zones is not limited to three; any number of heating zones may be provided.

There are provided on both ends of the cylindrical member 30 tire flanges 33. The tire flanges 33 are supported by their respective roller support members 35 secured to the mount 19 of the support base 18.

Figure 2:
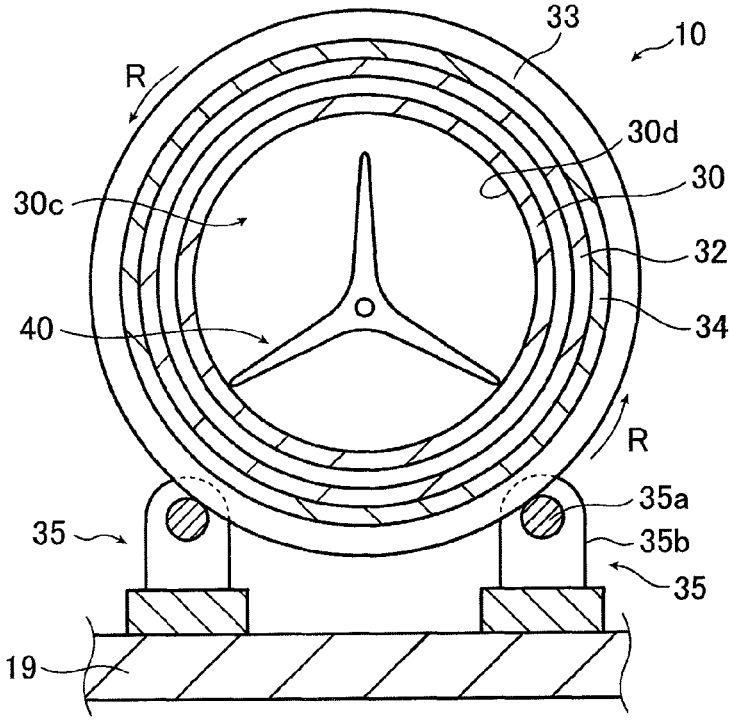
FIG. 2 is a cross section taken along line L-L of FIG. 1.

As illustrated in FIG. 2, each of the roller support members 35 comprises rotary members 35*a* in contact with the tire flange 33 and support members 35*b* rotatably bearing the rotary members 35*a*.

As illustrated in FIG. 1, a drive chain 37 connected via power transmission mechanism (not shown) to a drive source is passed over one of the two tire flanges 33, the one provided on the side closer to the supply unit 12. Upon receiving drive force from the drive source, the drive chain 37 causes the tire flange 33 to rotate, turning the cylindrical member 30.

In the inner space 30*c* of the cylindrical member 30, a plurality of ruddy blade members 40 are disposed independently of each other in the longitudinal direction of the cylindrical member 30. The ruddy blade members 40 constitute a blade unit 39.

There is provided at the rear end of the cylindrical member 30 a blade stopper 31 to prevent the ruddy blade members 40 from moving to the outside of the cylindrical member 30.

Next, the ruddy blade members (agitation members) 40 will be described.

As described later, the ruddy blade members 40 roll and turn inside the cylindrical member 30 to stir, distribute, size, and crush the subject material and prevent the subject material from adhering to and depositing on an inner wall surface 30*d* of the cylindrical member 30.

Figure 3:
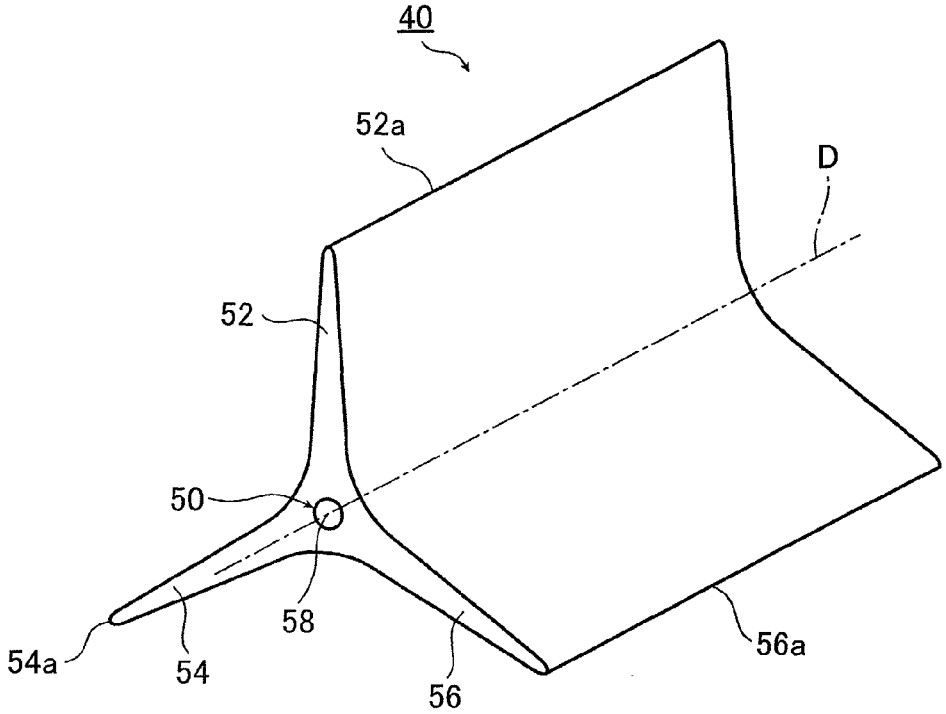
FIG. 3 is a schematic perspective illustrating a blade member used in the rotary agitation type heat treatment apparatus according to the first embodiment of the invention.

As illustrated in FIG. 3, each of the ruddy blade members 40 comprises a shaft structure 50 and three flat-plate-shaped blades 52, 54, and 56 provided at equal intervals of 120°. The shaft structure 50 is formed with a circular hole 58 and is thus hollow. The blades 52, 54, and 56 extend in the longitudinal direction of the shaft structure 50. The circumcircle of the blades 52, 54, and 56 of the ruddy blade members 40 has a diameter smaller than the inner diameter of the cylindrical member 30. Edge portions 52*a*, 54*a*, and 56*a* of the blades 52, 54, and 56 preferably have a substantially semi-circular configuration.

Each of the ruddy blade members 40 has end faces opposite those of adjacent ruddy blade members 40 formed into a convex configuration, preferably a substantially semi-circular configuration.

The ruddy blade members 40 are made of a ceramic material, which preferably has the same composition as the cylindrical member 30.

The shaft structure 50 of the ruddy blade members 40 has a hollow structure but is not limited thereto and may have a solid structure.

The blades 52, 54, and 56 smoothly connect with the shaft structure 50 in a cross section perpendicular to the longitudinal direction of the shaft structure 50, the adjacent blades 52 and 54 having such a configuration that the edge portion 52*a* connects with the edge portion 54*a* through a curve that is most bulged in its portion near the shaft structure 50. Likewise, the adjacent blades 54 and 56 have such a configuration that the edge portion 54*a* connects with the edge portion 56*a* through a curve that is most bulged in its portion near the shaft structure 50, and the adjacent blades 52 and 56 have such a configuration that the edge portion 52*a* connects with the edge portion 56*a* through a curve that is most bulged in its portion near the shaft structure 50. The shaft structure 50 is a central coupling portion to which respective bases of the blades 52, 54, and 56 are coupled.

The ruddy blade members 40 have a circumcircle 41, i.e., the circle circumscribing the edge portions 52*a*, 54*a*, and 56*a* of the blades 52, 54, and 56, having a diameter that is smaller than the inner diameter of the cylindrical member 30. Therefore, each of the ruddy blade members 40, as placed inside the cylindrical member 30, has say the blade 52 among the three blades 52, 54, and 56 out of contact with the inner wall surface 30*d* of the cylindrical member 30 as illustrated in FIG. 2. In other words, when the cylindrical member 30 is not rotating, the ruddy blade members 40 are stationary with two blades in contact with the inner wall surface 30*d* of the cylindrical member 30. The ruddy blade members 40 are disposed in the inner space 30*c* of the cylindrical body 30 so that a virtual center line D of the shaft structure 50 (see FIG. 3) is substantially or approximately parallel to a rotation axis (virtual center line) a of the cylindrical member 30 (see FIG. 1).

When the cylindrical member 30 starts to rotate in a rotating direction R, the ruddy blade members 40 move in the rotating direction of the cylindrical member 30 with the edge portions of the blades in contact with the inner wall surface 30*d* of the cylindrical member 30 according to the rotation of the cylindrical member 30. A given amount of movement of the blades changes the position of the center of gravity of the ruddy blade members 40, causing the edge portion of the blade that has been out of contact with the inner wall surface 30*d* of the cylindrical member 30 to hit the inner wall surface 30*d* of the cylindrical member 30. Thus, the rotation of the cylindrical member 30 causes the ruddy blade members 40 to roll and turn in the same direction.

Therefore, one or two blades of two or more blades are in contact with the inner wall surface 30*d* of the cylindrical member 30 so that the ruddy blade members 40 is supported by the cylindrical member 30.

As the cylindrical member 30 rotates, one blade in contact with the inner wall surface 30*d* of the cylindrical member 30 become out of contact with the inner wall surface 30*d* of the cylindrical member 30, and another blade out of contact with the inner wall surface 30*d* of the cylindrical member 30 become in contact with the inner wall surface 30*d* of the cylindrical member 30 so that a plurality of blades roll and turn in the cylindrical member 30, and the ruddy blade members 40 agitates the material to be treated being supplied in the cylindrical member 30.

In this case, the ruddy blade members 40 come into contact with the adjacent ruddy blade members 40 (the ruddy blade members 40 located on the side behind the drawing in FIG. 2) with the end faces of the three blades 52, 54, and 56 and thus roll and turn stably together.

The moving speed of the edge portion of the blade member 40 at which the blade 52 hits the inner wall surface 30*d* of the cylindrical member 30 is greater than the rotation speed of the cylindrical member 30. Therefore, the subject material contained in the cylindrical member 30 is distributed throughout the inner space 30*c* of the cylindrical member 30 by the rotation of the ruddy blade members 40.

When the subject material consists of small-diameter particles, the subject material can be distributed so as to float in the cylindrical member 30 and therefore heat-treaded efficiently.

A subject material having a relatively large weight slides over the surfaces of the blades 52, 54, and 56, as the ruddy blade members 40 rotate. As the subject material is allowed to slide over the surfaces of the blades 52, 54, and 56, the heat of the blades 52, 54, and 56 of the ruddy blade members 40 is transferred to the subject material, enabling an efficient heat treatment.

Although the subject material may adhere to the surfaces of the ruddy blade members 40 or to the inner wall surface 30*d* of the cylindrical member 30, the subject material stuck to the blades or the cylindrical member 30 can be detached from the blades 52, 54, and 56 or the cylindrical member 30 by impact generated as the blades 52, 54, and 56 are caused to hit the inner wall surface 30*d* of the cylindrical member 30 by the rotation of the ruddy blade members 40 as described above. Thus, the subject material that would otherwise remain stuck to, for example, the blades 52, 54, and 56 can be minimized, so that obstruction of the subject material inside the cylindrical member 30 does not occur, and efficient heat treatment can be achieved.

Next, the operation of the rotary agitation type heat treatment apparatus 10 will be described.

Figure 4:
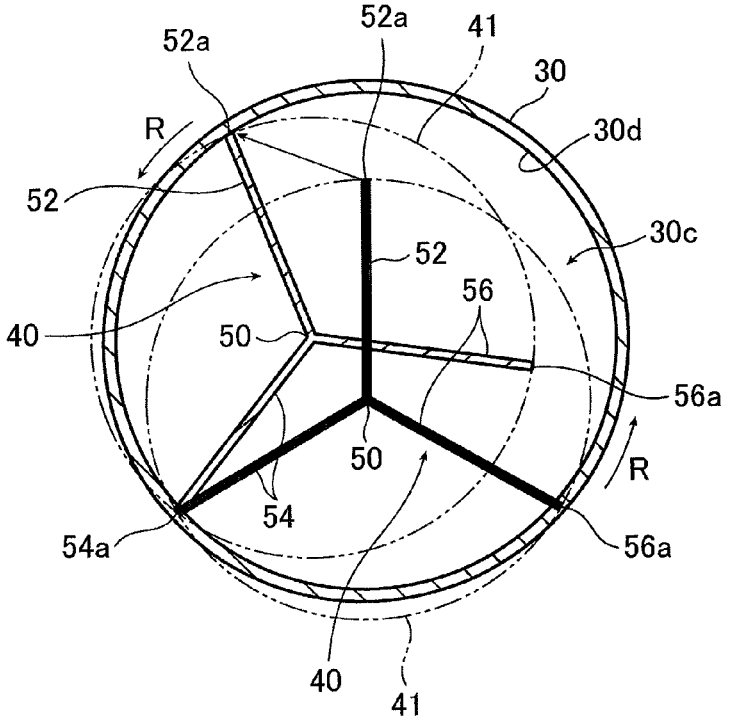
FIG. 4 is a schematic view for explaining an example of the operation of the rotary agitation type heat treatment apparatus according to the first embodiment of the invention.
Figure 5:
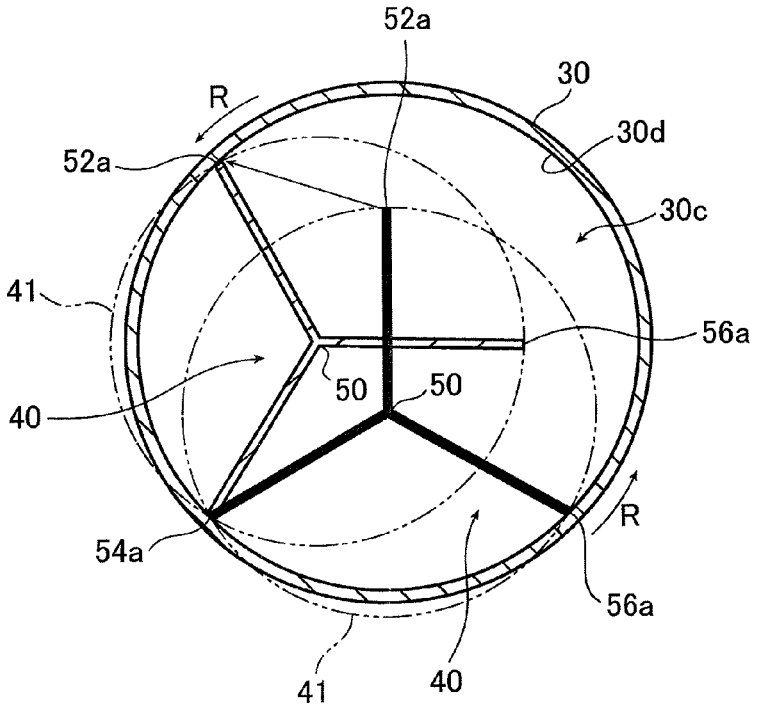
FIG. 5 is a schematic view explaining another example of the operation of the rotary agitation type heat treatment apparatus according to the first embodiment of the invention.

FIG. 4 is a schematic view explaining an example of the operation of the rotary agitation type heat treatment apparatus according to the first embodiment of the invention. FIG. 5 is a schematic view explaining another example of the operation of the rotary agitation type heat treatment apparatus according to the first embodiment of the invention.

In the rotary agitation type heat treatment apparatus 10, the heater member 32 first heats the cylindrical member 30 to a given temperature, at which the cylindrical member 30 is then kept. Subsequently, raw materials of the positive electrode material of a secondary lithium-ion battery, for example, powder of a lithium compound such as $Li_2O$ or $Li_2CO_3$ and powder of a metal compound such as MnO, $MnO_2$, and $Mn_2$, are mixed at a given ratio to obtain mixed powder as subject material. The mixed powder is subjected to granulation using a granulator, and the granulated powder thus obtained are fed into the hopper 22. The mixed powder may be granulated using, for example, a granulation method described in Japanese Patent Application No. 2009-192452.

Upon actuation of a feeder provided in the supply duct 24, the granulated powder (subject material) supplied into the hopper 22 is extruded toward the treatment unit 14. Thus, the subject material is supplied into the cylindrical member 30 of the treatment unit 14.

The cylindrical member 30 is now being rotated by the power transmission mechanism (not shown) through the drive chain 37 at a given rotation speed in the rotating direction R. In this state, the granulated powder (subject material) undergoes heat treatment or baking as the granulated powder is stirred by the ruddy blade members 40 (blade unit 39) and moved toward the opening 30*b* on the other end of the cylindrical member 30.

Thus, in the rotary agitation type heat treatment apparatus 10 according to this embodiment, the above granulated powder (subject material) is fed into the hopper 22 and undergoes continuous heat treatment such as baking as the granulated powder is stirred in the treatment unit 14 without the granulated powder adhering to and growing on the ruddy blade members 40 or the inner wall surface 30*d* of the cylindrical member 30, so that a baked product, i.e., the positive electrode material of a high-quality secondary lithium-ion battery free from contamination by metal components.

As illustrated in FIG. 4, when the cylindrical member 30 is at a standstill before it starts rotating, a blade member 40 stands, with the edge portion 54*a* of the blade 54 and the edge portion 56*a* of the blade 56 in contact with the inner wall surface of the cylindrical member 30, the edge portion 52*a* of the blade 52 being out of contact with the inner wall surface 30*d* of the cylindrical member 30.

Rotation of the cylindrical member 30 in the rotating direction R caused by a power transmission mechanism (not shown) causes the ruddy blade members 40 also to roll and turn. Because the diameter of the circumcircle of the ruddy blade members 40 is smaller than the inner diameter of the cylindrical member 30, the ruddy blade members 40 pivot on the edge portion 54*a* of the blade 54, for example, among the three blades 52, 54, and 56 of the ruddy blade members 40 as the cylindrical member 30 rotates. At this time, the edge portion 56*a* of the blade 56 out of the edge portions 52*a*, 56*a* of the other two blades 52, 56 disengages from the inner wall surface 30*d* of the cylindrical member 30, so that the blade 56 stays in the air while the edge portion 52*a* of the remaining blade 52 hits the inner wall surface 30*d* of the cylindrical member 30. Thus, as the cylindrical member 30 rotates, two blades out of the blades 52, 54, and 56 are always in contact with the inner wall surface 30*d* of the cylindrical member 30 while one, staying in the air, always rolls and turns before hitting the inner wall surface 30*d* lying in the rotating direction. Thus, the subject material can be caused to distribute so as to float while both the cylindrical member 30 and the ruddy blade members 40 are vibrated, preventing the subject material from adhering to and depositing on the inner wall surface 30*d*. Therefore, when the subject material is granulated powder obtained by granulating mixed powder containing powder of a lithium compound and powder of a metal compound, melting and adhesion of lithium to the inner wall surface 30*d* of the cylindrical member 30 during heat treatment can be prevented.

In addition, because the cylindrical member 30 and the ruddy blade members 40 are made of ceramic materials, the subject material is never subject to foreign metal contamination due to, for example, dissolution of metallic ions or occurrence of metal powder resulting from abrasion caused by mechanical contact.

The blade member 40 as shown in FIG. 5 has the circumcircle 41 whose diameter is 80% on the inner diameter of the cylindrical member 30. Blades of the blade member 40 in FIG. 5 move more greatly than those of the blade member 40 in FIG. 4, leading to a higher agitation effect but with an increase in impact.

A large impulsive force is effective indeed at preventing the adhesion or seizing of the subject material but enhances the risk of damage on impact to the inner wall surface 30*d* of the cylindrical member 30, the edge portions 52*a*, 54*a* and 56*a* of the blades 52, 54 and 56 of the blade member 40, the shaft structure 50 or the like. Ceramics has a poor resistance to mechanical impact, so that it is not appropriate to increase the impulsive force arising in a cylindrical member of a ceramic material provided with a ceramic blade member as compared with that in a cylindrical member of metal provided with a metallic blade member because damage to the cylindrical member 30 and the blade member 40, both made of a ceramic material, are more liable to occur as described above.

The rotating speed of the cylindrical member 30 made of a ceramic material, the separation between the cylindrical member 30 and the blade member 40 made of a ceramic material that is the difference between the inner diameter of the member 30 and the diameter of the circumcircle 41 of the member 40, and the weight of the blade member 40 made of a ceramic material are factors influencing the impulsive force. It is not appropriate to increase the weight of the blade member 40 made of a ceramic material because the load on the cylindrical member 30 is increased, and not appropriate either in terms of measures against the thermal shock due to the temperature reduction upon cooling. The rotating speed of the cylindrical member 30 is preferably 0.3 to 30 m/min, and the separation as above preferably comprises 1 to 20%, more preferably 1 to 10% of the inner diameter of the cylindrical member 30. In other words, the diameter of the circumcircle 41 of the blade member 40 is preferably 80 to 99%, more preferably 90 to 99% on the inner diameter of the cylindrical member 30.

In the steps of heating and cooling the cylindrical member 30 made of a ceramic material, damage to the cylindrical member 30 due to thermal shock may be prevented by verifying the temperature increase or reduction rate so as to increase or reduce the temperature at appropriate rates. In order to prevent damage to a ceramic member due to the thermal shock upon heating and cooling, it is necessary to increase or reduce the temperature at a low rate, such as a rate of 100° C./hour for temperature increase or a rate of 50° C./hour for temperature reduction depending on the size of the apparatus. In particular, the temperature increase or reduction rate is different between the cylindrical member 30 made of a ceramic material and the blade member 40 as inserted in the member 30. In other words, the cylindrical member 30 made of a ceramic material that is located outside is quickly increased or reduced in temperature, while the blade member 40 as located inside is increased or reduced in temperature rather slowly. The difference in temperature increase or reduction rate will produce the difference in thermal contraction rate, and such difference between the members 30 and 40 causes damage, which should be prevented. Especially for the blade member 40 upon cooling, a precise control of cooling temperatures is required. When the blade member 40 is cooled, the shaft structure is cooled more slowly than the blades, so that thermal shock damage occurs. It is preferable for the prevention of thermal shock damage due to the internal delay of cooling that the shaft structure 50 of the blade member 40 is made so hollow as not to have an excessively large wall thickness.

As described before, the blade member 40 of this embodiment has the shaft structure 50 which is made hollow by forming the hole 58 therein, so that it is possible particularly in a cooling step during the shutdown of the apparatus or the like to lessen the temperature difference during cooling between the shaft structure and the blades of the blade member 40 so as to prevent damage due to thermal shock.

The blade member 40 with a larger size will collide against the inner wall surface 30*d* of the cylindrical member 30 with a larger impulsive force and, accordingly, with a higher risk of damage to both members. Such risk, however, may be decreased by making the shaft structure 50 hollow to thereby reduce the weight of the blade member 40.

Baking using a roller hearth kiln is a currently mainstream method of baking a positive electrode material for secondary lithium-ion batteries. A roller hearth kiln requires about 20 hours for temperature increase and maintenance, with the time to be taken for the whole production including a cooling process being 30 hours or more.

On the other hand, use of the rotary agitation type heat treatment apparatus 10 of this embodiment makes it possible to reduce the heat treatment time to an extent of only 30 minutes without deterioration in product quality in the production of a positive electrode material for secondary lithium-ion batteries, for instance, which allows the production including a cooling process to be carried out within one hour. In consequence, production costs of a positive electrode material for secondary lithium-ion batteries can be reduced and, in addition, $CO_2$ emissions can significantly be suppressed during the production. Moreover, a considerable contribution can be made to global environmental conservation with the rotary agitation type heat treatment apparatus 10 of this embodiment because a secondary lithium-ion battery using the positive electrode material for secondary lithium-ion batteries as produced on the apparatus 10 is usable for electric vehicles, hybrid vehicles, and the like.

Figure 6:
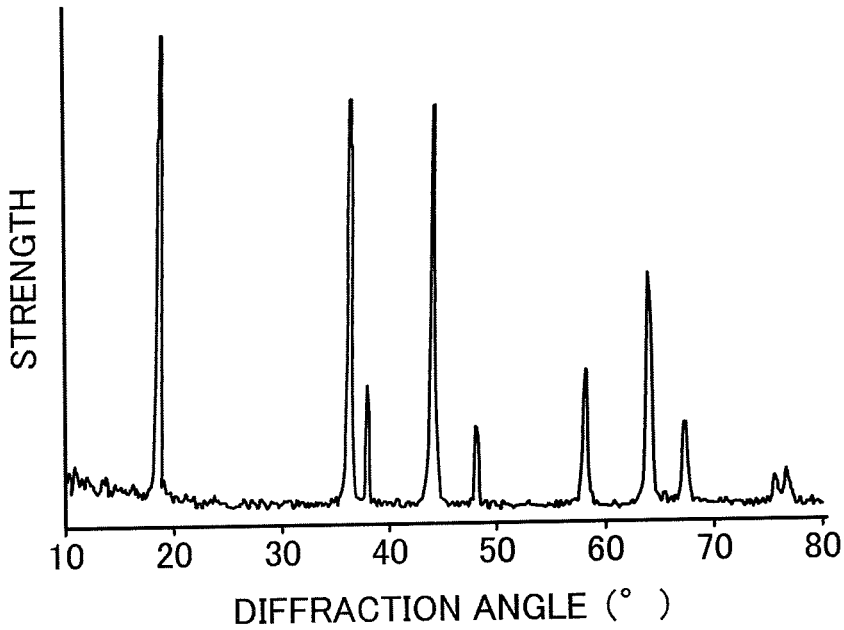
FIG. 6 is a graph illustrating a diffraction pattern of the positive electrode material of a secondary lithium-ion battery manufactured using the rotary agitation type heat treatment apparatus according to the first embodiment of the invention.

As shown in FIG. 6, lithium manganate ($LiMn_2O_4$) with a favorable crystal structure can be obtained in this embodiment as a positive electrode material for secondary lithium-ion batteries by using lithium carbonate ($Li_2CO_3$) and manganese dioxide ($MnO_2$) as the subject material.

In this embodiment, the configuration of the blade member 40 is not limited to that as shown in FIG. 3. A blade member 40*a* shown in FIG. 7A, for instance, may also be used.

Figure 7A:
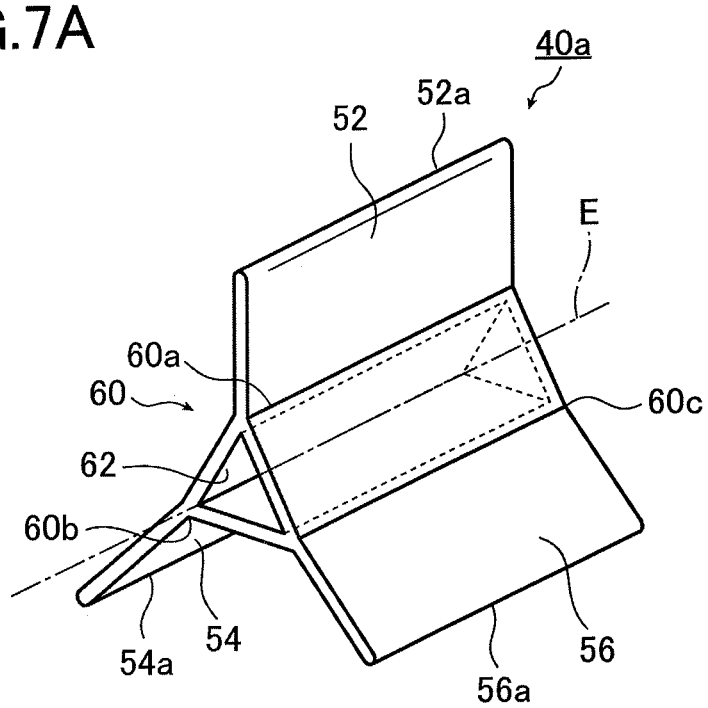
FIG. 7A is a schematic perspective illustrating a first variation of the blade member used in the rotary agitation type heat treatment apparatus according to the first embodiment of the invention.

The blade member 40*a* as shown in FIG. 7A is substantially the same as the blade member 40 of FIG. 3 except for the configuration of a shaft structure 60, so that detailed description is made only on the shaft structure 60.

The shaft structure 60 of the blade member 40*a* is constituted of a triangular prism, with its bases each having a triangular hole 62 formed therein. On edges 60*a*, 60*b* and 60*c* of the blade member 60, blades 52, 54 and 56 are provided, respectively.

Figure 7B:
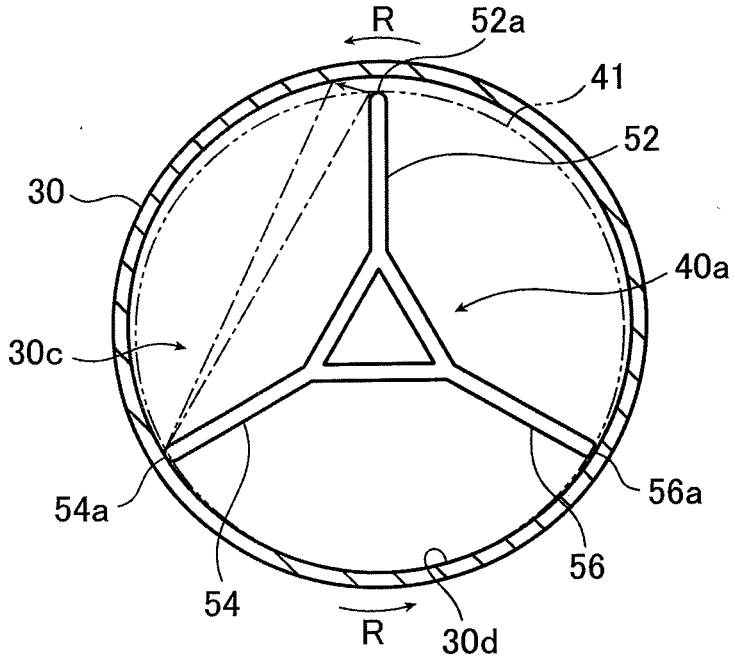
FIG. 7B is a schematic view for explaining an example of operation of the rotary agitation type heat treatment apparatus according to the first embodiment using the blade member illustrated in FIG. 7A.

The blade member 40*a* as a first modification is also placed in the inner space 30*c* of the cylindrical member 30. In the cylindrical member 30 which is at rest, the blade member 40*a* freely stands such that an edge portion 52*a* of the blade 52 is not in contact with the inner wall surface 30*d* of the cylindrical member 30, while edge portions 54*a* and 56*a* of the blades 54 and 56 are abutting on the inner wall surface 30*d*, as shown in FIG. 7B. The blade member 40*a* is positioned in the inner space 30*c* of the cylindrical member 30 so that a virtual center line E of the shaft structure 60 (see FIG. 7A) may approximately be parallel to the virtual center line a of the cylindrical member 30 (see FIG. 1).

If the cylindrical member 30 is rotated in a rotating direction R, the blade member 40*a* is also rotated in a rolled manner. Since the diameter of a circumcircle 41 of the blade member 40*a* is smaller than the inner diameter of the cylindrical member 30, the blade member 40*a* pivots during the rotation of the cylindrical member 30 on the edge portion 54*a* of the blade 54 out of its three blades 52, 54 and 56. At the same time, out of the edge portions 52*a* and 56*a* of the other two blades 52 and 56, the edge portion 56*a* of the blade 56 comes away from the inner wall surface 30*d* of the cylindrical member 30, with the blade 56 being made suspended in midair, and the edge portion 52*a* of the last blade 52 collides against the inner wall surface 30*d* of the cylindrical member 30. In consequence, the subject material undergoes heat treatment under the agitation by the blade member 40*a*, while prevented from the adhesion and seizing to the cylindrical member 30 and the blade member 40*a* by the vibration as generated in each of the members 30 and 40*a*.

Figure 8A:
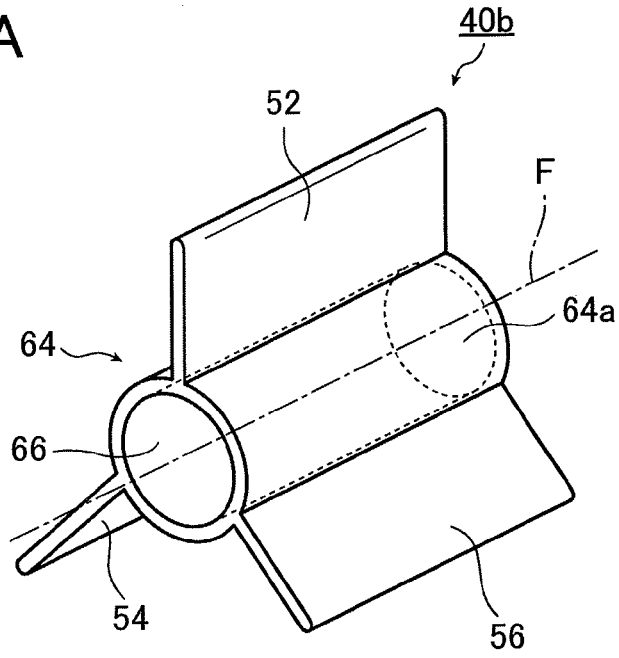
FIG. 8A is a schematic perspective illustrating a second variation of the blade member used in the rotary agitation type heat treatment apparatus according to the first embodiment of the invention.

A blade member 40*b* shown in FIG. 8A is also usable as the blade member 40 of this embodiment.

The blade member 40*b* as shown in FIG. 8A is substantially the same as the blade member 40 of FIG. 3 except for the configuration of a shaft structure 64, so that detailed description is made only on the shaft structure 64.

The shaft structure 64 of the blade member 40*b* is constituted of a cylinder, with its bases each having a circular hole 66 formed therein. On a lateral face 64*a* of the shaft structure 64, three blades 52, 54 and 56 are radially provided in positions of three generatrices spaced at intervals of 120°.

Figure 8B:
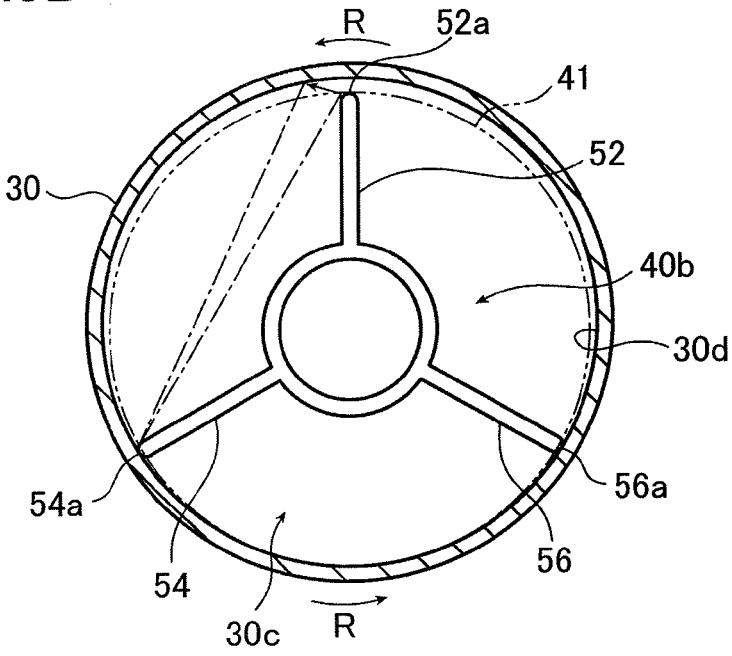
FIG. 8B is a schematic view for explaining the operation of the rotary agitation type heat treatment apparatus according to the first embodiment using the blade member illustrated in FIG. 8A.

The blade member 40*b* as a second modification is also placed in the inner space 30*c* of the cylindrical member 30. In the cylindrical member 30 before rotation, the blade member 40*b* freely stands such that an edge portion 52*a* of the blade 52 is not in contact with the inner wall surface 30*d* of the cylindrical member 30, while edge portions 54*a* and 56*a* of the blades 54 and 56 are abutting on the inner wall surface 30*d*, as shown in FIG. 8B. The blade member 40*b* is positioned in the inner space 30*c* of the cylindrical member 30 so that a virtual center line F of the shaft structure 64 (see FIG. 8A) may approximately be parallel to the virtual center line a of the cylindrical member 30 (see FIG. 1).

If the cylindrical member 30 is rotated in a rotating direction R, the blade member 40*b* is also rotated in a rolled manner. Since the diameter of a circumcircle 41 of the blade member 40*b* is smaller than the inner diameter of the cylindrical member 30, the blade member 40*b* pivots during the rotation of the cylindrical member 30 on the edge portion 54*a* of the blade 54 out of its three blades 52, 54 and 56. At the same time, out of the edge portions 52*a* and 56*a* of the other two blades 52 and 56, the edge portion 56*a* of the blade 56 comes away from the inner wall surface 30*d* of the cylindrical member 30, with the blade 56 being made suspended in midair, and the edge portion 52*a* of the last blade 52 collides against the inner wall surface 30*d* of the cylindrical member 30. In consequence, the subject material undergoes heat treatment under the agitation by the blade member 40*b*, while prevented from the adhesion and seizing to the cylindrical member 30 and the blade member 40*b* by the vibration as generated in each of the members 30 and 40*b*.

The following description is made on the second embodiment of the present invention.

Figure 9:
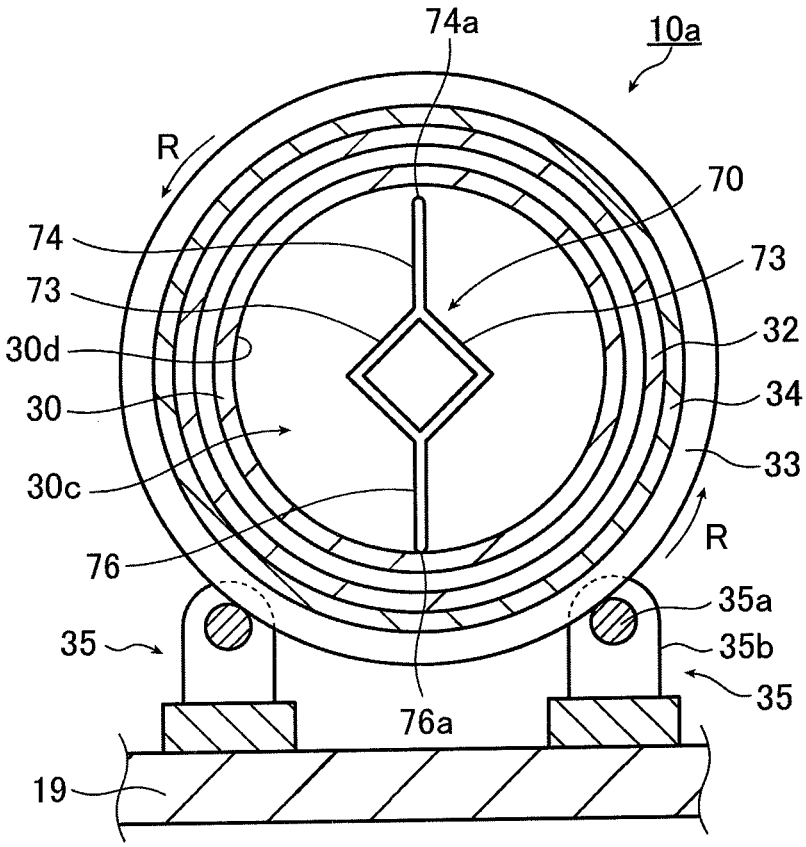
FIG. 9 is a schematic cross section illustrating a rotary agitation type heat treatment apparatus according to a second embodiment of the invention.
Figure 10A:
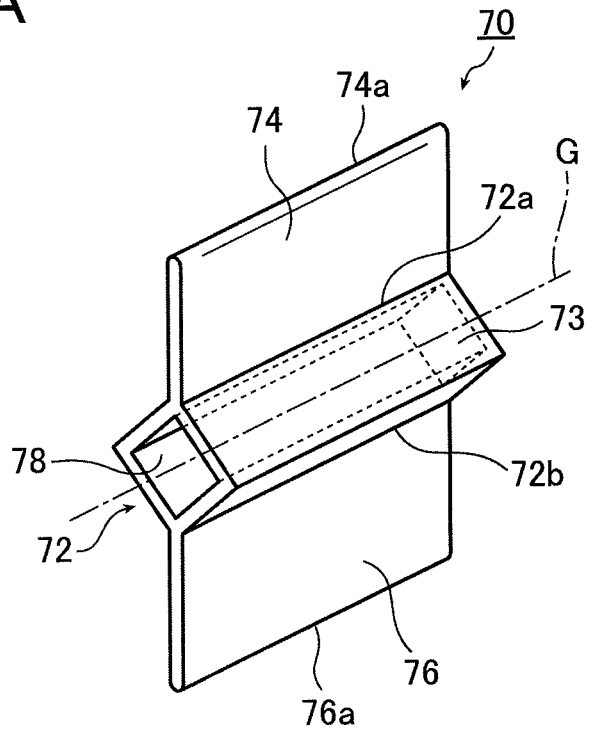
FIG. 10A is a schematic perspective illustrating a blade member used in the rotary agitation type heat treatment apparatus according to the second embodiment of the invention.
Figure 10B:
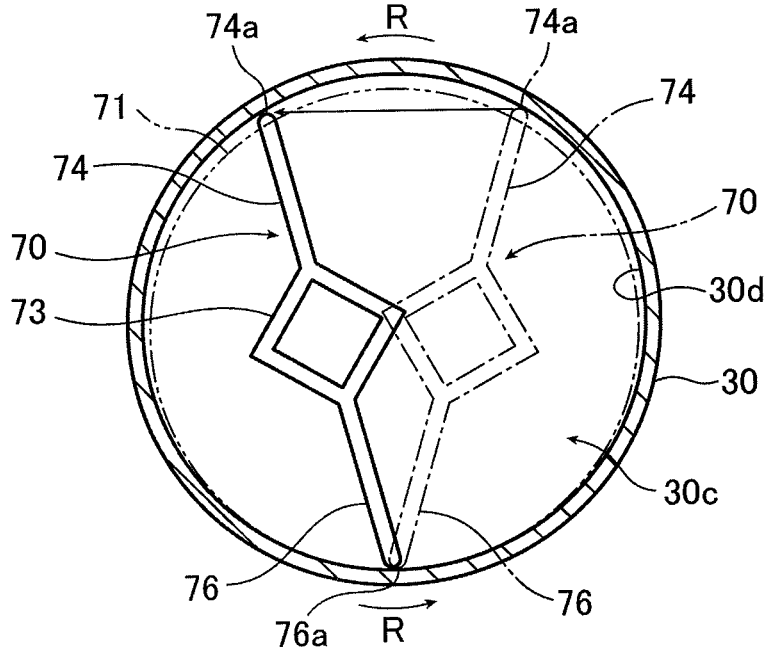
FIG. 10B is a schematic view for explaining an example of operation of the rotary agitation type heat treatment apparatus according to the second embodiment of the invention.

FIG. 9 is a schematic cross section illustrating a rotary agitation type heat treatment apparatus according to the second embodiment of the invention. FIG. 10A is a schematic perspective illustrating a blade member used in the rotary agitation type heat treatment apparatus according to the second embodiment of the invention, and FIG. 10B is a schematic view for explaining an example of operation of the rotary agitation type heat treatment apparatus according to the second embodiment of the invention.

In this embodiment, the same constituent elements as the rotary agitation type heat treatment apparatus 10 of the first embodiment as shown in FIGS. 1 through 3 are denoted by the same reference characters, with detailed description thereon being omitted.

The rotary agitation type heat treatment apparatus of this embodiment is substantially the same as the rotary agitation type heat treatment apparatus 10 of the first embodiment (see FIGS. 1 through 3) except for the configuration of a blade member 70 and is therefore no more detailed.

The blade member 70 of this embodiment is substantially the same as the blade member 40 of the first embodiment (see FIG. 3) except for the number of blades being two and the shape of a shaft structure 72, and is therefore no more detailed.

As shown in FIG. 10A, the blade member 70 has the shaft structure 72 constituted of a quadrangular prism, with its bases each having a quadrangular hole 78 formed therein.

On opposite edges 72*a* and 72*b* of the shaft structure 72, blades 74 and 76 are provided, respectively. As shown in FIG. 10B, the diameter of a circumcircle 71 of the blades 74 and 76 of the blade member 70 is smaller than the inner diameter of the cylindrical member 30. The diameter of the circumcircle 71 is preferably 95 to 99%, and more preferably 97 to 99% on the inner diameter of the cylindrical member 30. The diameter of the circumcircle (not shown) of the shaft structure 72 in the shape of a quadrangular prism is preferably 40 to 60% on the inner diameter of the cylindrical member 30.

As shown in FIGS. 9 and 10A, the blade member 70 is positioned in the inner space 30*c* of the cylindrical member 30 so that the edges 72*a* and 27*b* (namely, a virtual center line G of the shaft structure 72) may approximately be parallel to the virtual center line a of the cylindrical member 30 (see FIG. 1), with an edge portion 76*a* of the blade 76, for instance, being abutting on the inner wall surface 30*d* of the cylindrical member 30. In this embodiment, lateral faces 73 of the shaft structure 72 are tilted.

As shown in FIG. 10B, if the cylindrical member 30 is rotated in a rotating direction R, the blade member 70 is also rotated in a rolled manner. Since the diameter of the circumcircle 71 of the blade member 70 is smaller than the inner diameter of the cylindrical member 30, an edge portion 74*a* of the blade 74 is moved with reference to the edge portion 76*a* of the blade 76 toward the rotating direction R along with the shift in center of gravity of the blade member 70 during the rotation of the cylindrical member 30, and collides against the inner wall surface 30*d* of the cylindrical member 30. In consequence, vibration is generated in both the cylindrical member 30 and the blade member 70, which prevents the subject material from the adhesion and seizing to the members 30 and 70.

In this embodiment, the blade member 70 is so constructed as to have two blades. The blade member 70 as such is less increased in total weight as compared with the blade member with three blades of the first embodiment if the diameter of the circumcircle 71 of the blade member 70 is to be increased and the wall thickness of the shaft structure 72 is to be increased accordingly in order to improve the mechanical strength of the structure 72. Consequently, the load on the cylindrical member 30 that is caused by mechanical shock is reduced, leading to a lower risk of damage to the cylindrical member 30.

The blade member 70 with two blades of this embodiment is able to be made lighter than the blade member with three blades of the first embodiment, that is to say, exerts less impact on the cylindrical member 30 of a ceramic material with a reduced risk of damage thereto. Especially if the apparatus is to be increased in size, the blade member 70 with two blades which has a lower weight than a blade member with three blades allows reduction in weight load on the cylindrical member 30.

In comparison with the blade member 40 with three blades of the first embodiment, the blade member 70 with the two blades 74 and 76 is less effective indeed at distributing the subject material at the blade surfaces. In this embodiment, however, the lateral faces 73 of the shaft structure 72 are tilted to present slopes, so that the subject material is inversely agitated at the edge where two slopes meet, that is to say, the edge of the shaft structure 72 which has neither the blade 74 nor the blade 76 provided thereon. If the subject material is particulate, the inverted particles are separated from one another to improve the distribution effect, with a uniform heating of particles being thus achieved.

Similar to the first embodiment, lithium manganate ($LiMn_2O_4$) with the favorable crystal structure as shown in FIG. 6 can be obtained in this embodiment as a positive electrode material for secondary lithium-ion batteries by using lithium carbonate ($Li_2CO_3$) and manganese dioxide ($MnO_2$) as the subject material.

In the present invention, the subject material is not limited to positive electrode materials for secondary lithium-ion batteries. A material for dielectrics, such as barium titanate, is also available.

In the present invention, the shaft structure is not limited to the above embodiments but may be in the form of a polyangular prism other than those employed in the embodiments. Holes formed in the bases of the shaft structure are not limited in shape to the above embodiments either, that is to say, any polygonal shape is available for them.

The rotary agitation type heat treatment apparatus of the present invention has been described in detail as above. The present invention is in no way limited to the above embodiments, and various improvements and modifications are obviously possible within the scope of the present invention.

EXAMPLE

An example of the rotary agitation type heat treatment apparatus of the present invention is illustrated below.

In the example, raw materials for a positive electrode material for secondary lithium-ion batteries were used as the material to be treated, so as to produce the positive electrode material for secondary lithium-ion batteries.

The raw materials as used for the positive electrode material for secondary lithium-ion batteries were lithium carbonate ($Li_2CO_3$) and manganese dioxide ($MnO_2$). Lithium carbonate and manganese dioxide were combined together at a molar ratio of 1:1 and mixed, and the mixture was granulated. After sieving, granulated powder having such a particle size composition that particles with a diameter of not more than 0.25 mm comprise up to 20 wt % of the whole powder was finally obtained, and used as the material to be treated.

During the granulation, Roller Compactor model WP (manufactured by Turbo Kogyo Co., Ltd.) was used to conduct continuous granulation by solely applying a pressure with no binder helping granulation.

The rotary agitation type heat treatment apparatus according to the first embodiment of the invention that was manufactured with ceramics was used to perform heat treatment for baking on the material to be treated (granulated powder) under such production conditions that the temperature was 830° C., the retention time was 14 minutes, the feed rate was 21 kg/h, and the internal packing fraction was 9.7%, so as to produce the positive electrode material for secondary lithium-ion batteries. In this example, the production of the positive electrode material for secondary lithium-ion batteries that included a cooling process and so forth was accomplished within one hour. The cylindrical member 30 of the rotary agitation type heat treatment apparatus had an inner diameter of 150 mm and a length of 1800 mm.

The XRD pattern analysis as having been conducted on the obtained positive electrode material for secondary lithium-ion batteries proved that lithium manganate ($LiMn_2O_4$) with such a favorable crystal structure as shown in FIG. 6 with respect to the first embodiment was obtained. When the material to be treated was continuously baked under the production conditions as above, it was adhered neither to the cylindrical member nor the blade member. Thus, the rotary agitation type heat treatment apparatus of the present invention allowed a continuous production of a positive electrode material for secondary lithium-ion batteries using granulated powder as the material to be treated.

What is claimed is:

1. A rotary agitation type heat treatment apparatus comprising:

a cylindrical member for performing heat treatment on a material to be treated which is supplied inside the cylindrical member;

a rotating unit for rotating the cylindrical member;

a heating unit for heating the material to be treated which is supplied inside the cylindrical member; and agitation members arranged in the cylindrical member along a longitudinal direction, wherein:

the agitation members each have a shaft structure and two or more blades provided on the shaft structure;

the cylindrical member and the agitation members are constituted of a ceramic material;

the shaft structure of each of said agitation members is hollow and has holes formed in its both bases; and the material to be treated which is supplied inside the cylindrical member from one end thereof is heated by the heating unit and the cylindrical member is rotated by the rotating unit, so that the material to be treated is heat treated while agitated by the agitation members in the cylindrical member, and discharged out from another end of the cylindrical member.

2. The rotary agitation type heat treatment apparatus according to claim 1, wherein said shaft structure of each of said agitation members is arranged in substantially parallel to a rotation axis of the cylindrical member, said two or more blades of each of said agitation members are plate-shaped and radially provided on the shaft structure in an evenly spaced manner, one or two blades of said two or more blades of each of said agitation members are in contact with an inner wall surface of the cylindrical member so that said agitation members are supported by the cylindrical member as the cylindrical member rotates, in each of said agitation members, one blade of said two or more blades in contact with the inner wall surface of the cylindrical member become out of contact with the inner wall surface of the cylindrical member, and another blade of said two or more blades out of contact with the inner wall surface of the cylindrical member become in contact with the inner wall surface of the cylindrical member so that said two or more blades of each of said agitation members roll and turn in the cylindrical member, and said material to be treated being supplied in the cylindrical member is agitated by the agitation members.

3. The rotary agitation type heat treatment apparatus according to claim 1, wherein said two or more blades of each of said agitation members are plate-shaped and radially provided on the shaft structure in an evenly spaced manner, said shaft structure of each of said agitation members is a central coupling portion to which said two or more blades are coupled said agitation members are arranged in the cylindrical member such that a virtual center line of the central coupling portion may be substantially parallel to a rotation axis of the cylindrical member.

4. The rotary agitation type heat treatment apparatus according to claim 1, wherein said agitation members each have three blades provided on a periphery of the shaft structure in an evenly spaced manner.

5. The rotary agitation type heat treatment apparatus according to claim 1, wherein said agitation members each have two blades provided on a periphery of the shaft structure in an evenly spaced manner.

6. The rotary agitation type heat treatment apparatus according to claim 5, wherein:

the shaft structure of each of said agitation members is in a form of a quadrangular prism which is hollow and has quadrangular holes formed in its both bases, and said blades are radially provided on a pair of opposite edges of the quadrangular prism; and each agitation member is positioned in said cylindrical member so that a virtual center line of the quadrangular prism may be substantially parallel to a rotation axis of the cylindrical member.

7. The rotary agitation type heat treatment apparatus according to claim 1, wherein:

said shaft structure is in a form of a cylinder which is hollow and has circular holes formed in its both bases, and said blades are radially provided on generatrices of the cylinder; and each of said agitation members is positioned in said cylindrical member so that a virtual center line of the cylinder may be substantially parallel to a rotation axis of the cylindrical member.

8. The rotary agitation type heat treatment apparatus according to claim 1, wherein:

said shaft structure is in a form of a polyangular prism which is hollow and has polygonal holes formed in its both bases, and said blades are radially provided on edges of the polyangular prism; and each of said agitation members is positioned in said cylindrical member so that a virtual center line of the polyangular prism may be substantially parallel to a rotation axis of the cylindrical member.

9. The rotary agitation type heat treatment apparatus according to claim 1, wherein the blades of said agitation members have edge portions of a semicircular shape.

10. The rotary agitation type heat treatment apparatus according to claim 1, wherein said agitation members each have an end face brought into contact with an adjacent agitation member, and the end face is convex in shape.

11. The rotary agitation type heat treatment apparatus according to claim 1, wherein the ceramics of which said cylindrical member and said agitation members are constituted is one selected from among silicon carbide, alumina, mullite, and zirconia.

* * * * *